US005435897A

United States Patent [19]

Zannini

[11] Patent Number: 5,435,897

[45] Date of Patent: Jul. 25, 1995

[54] AUTOMATIZED EQUIPMENT FOR THE REPLACEMENT OF THE ANODES IN THE ELECTROLYTIC CELLS FOR ALUMINIUM PRODUCTION

[75] Inventor: Gianfranco Zannini, Limena, Italy

[73] Assignee: Techmo Car S.p.A., Limena Po, Italy

[21] Appl. No.: 191,317

[22] Filed: Feb. 1, 1994

[30] Foreign Application Priority Data

Feb. 25, 1993 [IT] Italy ..... MI93A0365

[51] Int. Cl.[6] ..... C25C 3/14; C25C 3/20; C25C 3/22

[52] U.S. Cl. ..... 204/245; 204/247

[58] Field of Search ..... 204/243 R, 244, 245, 204/246–247, 67

[56] References Cited

U.S. PATENT DOCUMENTS

| | | | |
|---|---|---|---|
| 3,663,411 | 5/1972 | Springer | 204/243 R |
| 3,769,195 | 10/1973 | Weterings | 204/244 |
| 4,032,020 | 6/1977 | Kato et al. | 214/1 BB |
| 4,053,384 | 10/1977 | Siegmund | 204/444 |
| 4,119,505 | 10/1978 | Baillot et al. | 204/67 |
| 4,510,033 | 4/1985 | Martin et al. | 204/245 |
| 4,701,249 | 10/1987 | Wisniewski et al. | 204/279 |
| 4,855,031 | 8/1989 | Zannini | 204/225 |
| 4,956,054 | 9/1990 | Dronnesund et al. | 204/245 X |

FOREIGN PATENT DOCUMENTS 0298198 3/1988 European Pat. Off. .

*Primary Examiner*—Donald R. Valentine
*Attorney, Agent, or Firm*—Collard & Roe

[57] ABSTRACT

Automatized equipment for the replacement of the anodes in the cells for aluminum production, comprising two modular structures suspended from saddles sliding on a bridge crane provided in the cell room, the first structure being provided with devices for crust breaking, the removal and laying of worn anodes on a platform translable on a special vehicle placed on a side of the cells, and then for hooking new anodes placed on the same platform and positioning them into the hollow space of the removed worn anodes and the second structure being provided with a device for cleaning the hollow space, and for collecting and transferring slags into a special container placed at the opposite side of the cells on a special vehicle, as well as of means for covering with alumina and/or other powdery materials the new repositioned anodes.

The equipment is also provided with electronic microprocessors for the automatized execution of the operations and "wire- and wireless" transmission systems for signal remote transmission and control.

23 Claims, 6 Drawing Sheets

AUTOMATIZED EQUIPMENT FOR THE REPLACEMENT OF THE ANODES IN THE ELECTROLYTIC CELLS FOR ALUMINIUM PRODUCTION

This invention refers to an equipment with automatic or semi-automatic working, suitable to permit the quick replacement of the anodes in the electrolytic cells for the production of primary aluminium, with a precise and quick positioning of the new anodes.

As known, the cells for the electrolytic production of primary aluminium with pre-baked anodes are equipped with a collector plate, constituting the cathode, placed on the bottom of the cell, made from graphite or the like, while the anode is constituted by a set of blocks from carbon-based material, provided with "shafts" connected, with the possibility of being removed, with a bus-bar (anodic bar). The set of blocks or anodes of each cell is dipped in the molten mass of the bath at a constant distance from the cathodic plate constituted by the surface of liquid aluminium.

As—as also is known—the electrolytic process gradually wears out the anodes, their frequent replacement is necessary, and such replacement requires that the base of each new anode comes to be, after the removal of the worn anode, at the same distance from the cathode as the worn replaced anode had.

At present, to replace the anodes, self-propelled trucks are used, which operate along the aisle of the cells arranged in an "end-to-end" position, or purposely equipped bridge cranes which run above the cells placed in a "side-to-side" position.

The limits of these systems consist especially in that they require large movement areas (self-propelled trucks) or in that, besides this, they require massive supporting structures because of their cumbersome mass (equipped bridge cranes).

According to the prior art, both the use of equipped bridge cranes or self-propelled trucks require always a full set of surveys and measurements to be carried out, which are delicate and exacting, in order to position exactly the base of the new anodes. Such machines have then a poor flexibility and a low operating speed, which contrasts with the high production power of the most updated cells and with the high degree of automation reached in the control and adjustment of said cells.

To obviate these drawbacks, both of a practical and economic nature, of the above mentioned known systems for replacing the anodes, an equipment has already been proposed for the mechanized replacement of the anodes, such as the one described by patent EP 0298198 (TECHMO Car SpA), which is substantially constituted by a module capable of allowing the removal of the worn anode and the repositioning of the new anode in a rather quick and exact manner, i.e., without requiring surveys and/or measurements to be carried out for realizing the exact positioning of the new anode. Such module is constituted by a cage-shaped structure open at the bottom and which can be hooked at the top to the crane of a bridge crane of a known sliding type, running above the cells, transversally to the direction of running of said bridge crane. Two coplanar flat beds, protruding in mutually opposite positions are placed at the base of the cage, wherein on each of said protruding flat beds a sliding saddle is mounted for the support and shifting of a new anode or of a worn anode. To the cage stem-shaped retractable elements are then associated, provided with the usual means for hooking it to the anode shaft, as well as with means for the lateral reference relatively to the shaft of an adjacent anode; besides, above said cage a saddle is provided which slides on horizontal rails parallel to those provided on said flat beds but perpendicularly directed relatively to same, which saddle is integral with a vertical telescopically extendable arm provided with the usual means for unlocking and locking the shaft of the anodes, respectively from and to said anodic bus bar, as well as means for clamping and lifting the worn anode and placing the latter on a side flat bed, and then for repositioning the new anode, which is present on the other flat bed in the same position as the worn anode had.

To said module also a hopper is associated which contains covering material for the new positioned anode, as well as crust-breakers of known beating type, and means for removing crust residuals.

This module, whose structure is such as to allow the mechanization of all the operation of anode replacement, while being efficacious and reliable, is practically very complicated and requires rather long times for the replacement of the anodes; besides, it cannot prevent harmful emisssions by residuals and carbon-based foams during the replacement of the anodes.

A purpose of this invention is to provide an automatized equipment for the replacement of the anodes in electrolytic cells for the production of aluminium, so designed as to result:

compact, so as to be suitable also in the applications more exacting from the dimensional point of view, simple and made up by a limited number of components, so as to ensure lightness, improve reliability and maintenance requirements and optimize automation of said equipment.

A further purpose of this invention is to allow the elimination of the need of carrying out hand surveys and measurements to perform the correct positioning of the new anode after the removal of the worn one, and to increase at the most the automation level of all the operations, with obvious practical and economic advantages.

A further purpose of this invention is to improve from the ecologic and environmental hygiene points of view, the process of anode replacement, reducing as much as possible smokes and emissions, both from the electrolytic cells, reducing therefore the time necessary for the operations and therefore the opening time of said cells, and from residuals and foams, unloading the same into closed containers.

A further purpose of this invention is to ensure the safety and comfort of the operator, keeping the latter far from the operation area and providing him anyhow with systems for remote monitor and control.

A further purpose of this invention is to provide an equipment of the above mentioned type having a such a structure as to allow for the replacement of the anodes of all the sides of the cells placed "side-to-side", without changing the position of the members that perform the removal of the worn anode and the following repositioning of the new one.

Still another purpose of this invention is to provide an equipment for anode replacement capable of carrying out the operation of anode replacement and the associated operations with the utmost rapidity and without downtimes.

These, and still further purposes, which shall be more clearly evinced from the following disclosure, are achieved by a modular automatized equipment for the replacement of the anodes in electrolytic cells for the production of aluminium, which equipment comprises, according to this invention:

a bridge crane or overhead travelling crane translable above rows of cells and provided with guides or rails arranged transversally to the running direction of said bridge crane, a first modular unit or module comprising a first saddle sliding on said guides or rails, and a first telescopically extendable structure, vertically hooked to said first saddle, to which first structure a first part of the means necessary to carry out the anode replacement operations is associated, a second modular unit or module comprising a second saddle sliding on said guides or rails, and a second telescopically extendable structure, vertically hooked to said second saddle, to which second structure the second and remaining part of the means necessary to carry out the anode replacement operations is associated, a control or service vehicle provided with a supervision and control cab, and translable parallelly along one of the two sides of the cell row and for the whole length of same, a container-vehicle translable parallelly along the other of the two sides of the cell row and for the whole length of same, said first modular unit and said second modular unit being suitable to carry out contemporaneously operating stages that are different from and complementary to one another, said stages being associated with the operation of anode replacement in a cell, in such a way as to substantially reduce the whole duration of said operation, and to greatly limit or substantially eliminate the emission of polluting and harmful smokes and gases.

More particularly said first part of means associated to said first module comprises hammer-like means or the like for breaking the crust around the worn anode, means for unkooking the shaft of the worn anode from the anodic bus bar and then for hooking the shaft of a new anode to the anodic bus bar, pliers-like means for holding the shafts of the worn anodes during their removal, and for clamping and positioning the new anodes, said means being incorporated in the telescopically extendable part of said first module, said second part of means associated to said second module comprises shovel-, bucket- or openable vice means for collecting slags from the anodic hollow space and for holding them until they are unloaded into a closable container associated to said container-vehicle placed at the side of the cells, a tank or container containing alumina powder or the like, and provided with means suitable to convey the powder for the covering of the upper part of the new repositioned anode, said control vehicle comprises a platform for collecting worn anodes and preparing the new ones for the hooking to said first module, whenever the latter translates for a pre-fixed length in correspondence of said platform, in such a way as to present the new anodes to said module, keeping the height of the anode base inalterated, said vehicle being driven by an operator along a route parallel to the anode replacement cell side and for the whole length of the cell room, said platform constituting also the means for the preliminary measurement of the clamp height of the shafts of the new anodes before their transfer into the anodic hollow space, said container-vehicle, translatable parallely to the cell side opposite to the one of anode replacement, is suitable to hold the slags unloaded from said second cleaning module, whenever it translates above said container-vehicle, into a container provided with closable doors, so as to substantially reduce the emissions of harmful smokes and gases in the environment, said control vehicle being also equipped with a cab provided with a suitably programmed computer, means for remote transmission, and monitors for the realization of the sequence of operating stages and in particular for checking the position reached by said modules during the work, and for deciding on the possible adjustments to be performed by hand.

More particularly, said first module and said second module have at least the telescopically extendable part rotatably mounted by at least 180° relatively to the part fixed to the relevant saddle, in order to allow the replacement of anodes of rows of parallel cells by translating the modules in the opposite direction, at the end of each row.

Such control vehicle is realized in such a way as to tow a wheeled platform, performing in this way the translation by means of a tow-arm, or to load a platform provided only with supporting legs, shifting under it by means of a special frame which has a lifting and translation motion. Besides, said modules can be equipped for the contemporaneous replacement of a couple of two adjacent anodes.

According to an alternative embodiment, particularly advantageous for instance when the invention has to be realized to renew an already existing and obsolete electrolytic plant, with little space available, the modular equipment according to this invention comprises:

a bridge crane or an overhead travelling crane running above rows of cells and provided with guides or rails arranged transversally to the shifting direction of said bridge crane, a first modular unit or module comprising a first saddle sliding along said guides or rails and a first structure hooked to said first saddle; to such first structure being associated hammer-like means or the like for breaking the crust around the worn anode, means for unhooking the shaft of the worn anode from the bus bar and for the following hooking of the shaft of a new anode to the bus bar, pliers-like means for holding the shafts of the worn anodes when the latter are removed, and for the following clamping and positioning of the new anodes, said first structure being also capable of moving transversally to the shifting direction of said first saddle and parallelly to that of said bridge crane, so as to be capable of translating for a given length, the bridge crane being standstill, along the aisle laterally to the cells, to lay the worn anodes on the bed of said aisle and to hook the new anodes placed on said same surface in such a way as to keep the height of the anode base inalterated, said surface also constituting the means for the preliminary measurement of the clamp height of the shafts of the anodes before their transfer into the anodic hollow space, a second modular unit or module comprising a second saddle sliding on said guides or rails, and a second structure hooked to said second saddle, to said second structure being associated shovel-, bucket or openable vice means for collecting the slags from the anodic hollow space and for holding them until they are unloaded into a closable container associated to said container-vehicle placed laterally to the cells, a tank or container containing alumina powder or the like, and provided with means suitable to convey the powder for covering the upper part of the new repositioned anode, a container-vehicle, translable parallelly along the side of the cell row opposite to that of the anode replacement, suitable to collect the slags unloaded from said second cleaning module whenever it translates above said container-vehicle, to said bridge crane being associated a suitably programmed computer, means for remote transmission and monitors for realizing the operating stages, and in particular for checking the position reached by said modular units in the working stage and for deciding on the possible adjustments to be performed by hand, According to this alternative embodiment, the utilization of the control vehicle is avoided, which is therefore advantageously eliminated especially when there is little space available or when one does not wish or cannot encumber the aisle along the cell rows with a control vehicle which has always a rather big size.

Further characteristics and advantages of this invention are more clearly stressed by the following disclosure in detail thereof, which follows a preferred non exclusive embodiment, and which is made by referring to the hereto attached drawings, which are given for only indicative and non limitative purposes, wherein:

DETAILED DESCRIPTION OF THE PREFERRED EMBODIMENTS

Referring to the aforementioned figures, the equipment for replacing the anodes, subject matter of this invention, is substantially constituted by two modular polyfunctional structures 1 and 2, having substantially equal shape and size, of which the structure or module 1 is designed to perform the operations of crust breaking and anode replacement, while the structure or module 2 is designed to perform the cleaning and collection of crust residuals remained in the hollow space after the removal of the worn anode or anodes and also to cover with alumina the new anode repositioned in said hollow space.

Said modules 1 and 2 are constituted by two hollow bodies 1*a*–1*b* and, respectively, 2*a*–2*b*, telescopically extendable for the purposes which shall be explained later on.

Figure 1:
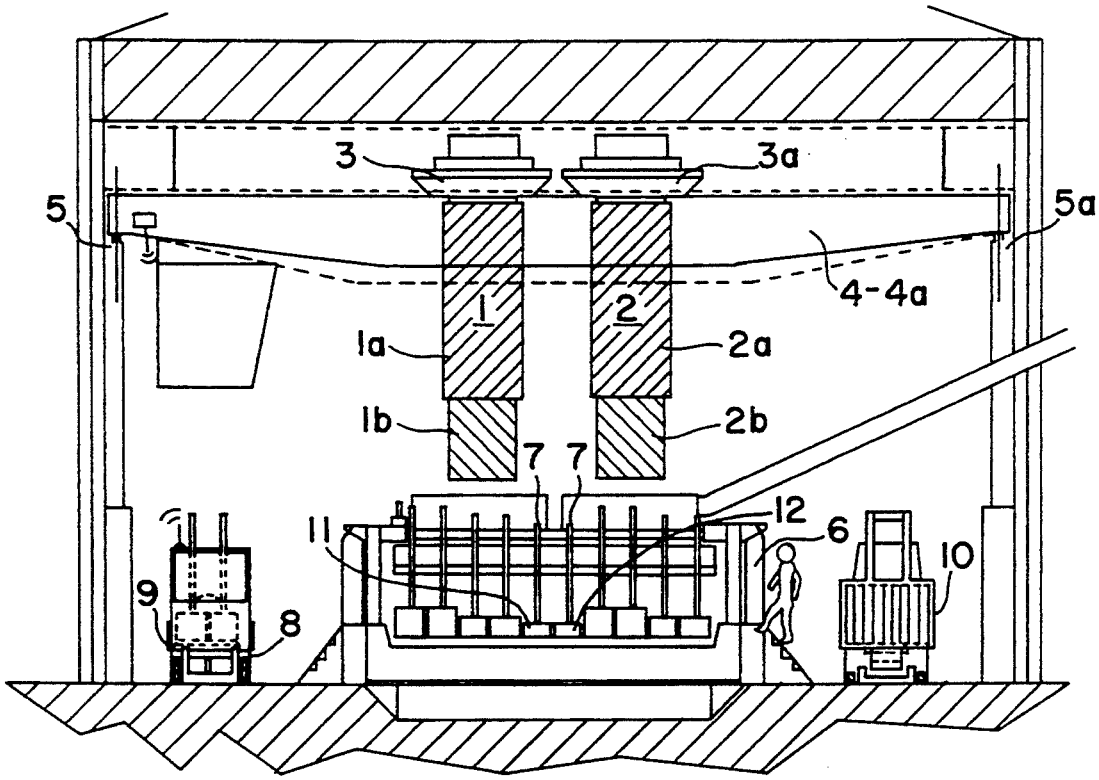
FIG. 1 is a schematic front view of the equipment subject matter of this invention, with both modules in standstill position above the electrolytic cells.
Figure 2:
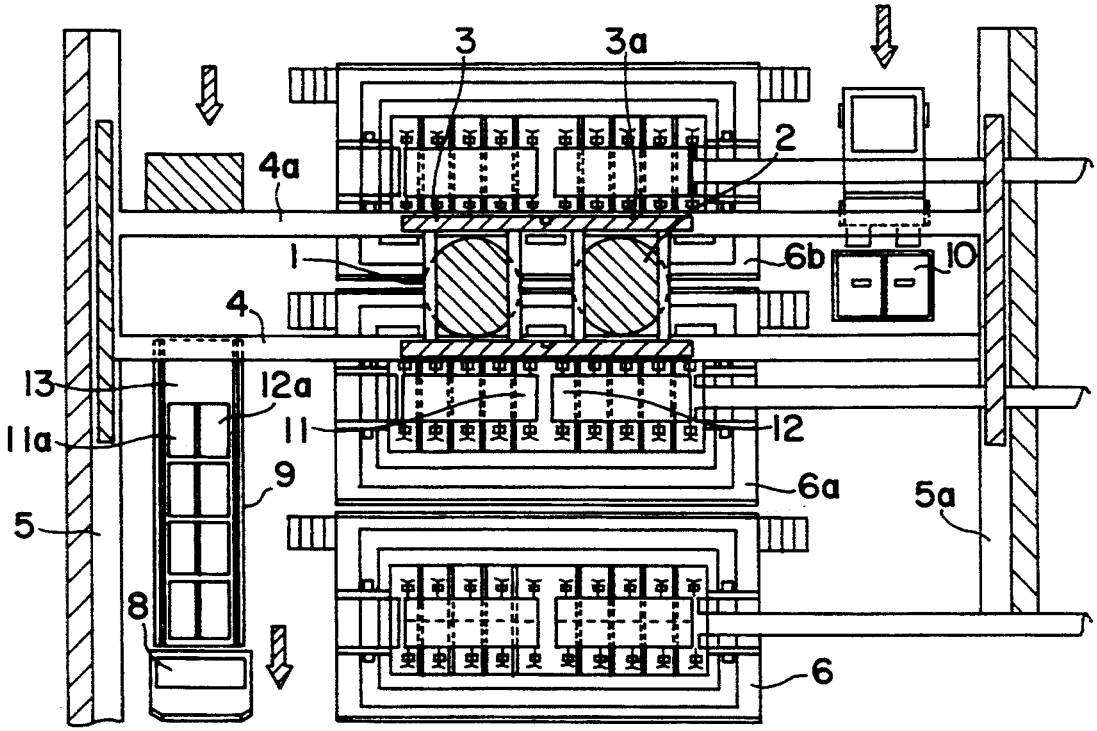
FIG. 2 is a schematic plan view of the equipment of FIG. 1.

The upper part 1*a* and 2*a* of said module is rigidly anchored to the base of a respective motor-saddle 3 and 3*a*; said saddles are slidingly mounted on two parallel cross-pieces 4–4*a* which constitute a bridge crane that slides on rails 5–5*a* parallelly placed at the opposite sides of the rows of electrolytic cells, globally indicated with 6–6*a*–6*b* on FIG. 2; in this way, modules 1 and 2 shift on the bridge crane along a direction perpendicular to the shift of said bridge crane, remaining vertically suspended above the cells, as is clearly visible on FIG. 1.

In part 1*b*, telescopically protruding from the fixed part 1*a* of the anode replacement module 1, the usual devices for crust breaking before the removal of the worn anode are provided, which crust breakers may be of the hydraulic hammer type, controlled by hydraulically operated levers, or there may be a vibrating cutter crust breaking system; besides, the anode replacement module 1 is also provided with a device for the positioning and stop of the telescopic part relatively to the worn anode, pliers for hooking one or two shafts 7, and devices for unscrewing the clamp, removing in this way the shaft from the bus bar and to re-attach the shaft or shafts of the new anode to the same bus bar; besides, position transducers (encoders or the like) are associated to said module 1, suitable to allow the storing (in a computer which shall be described later on) of the movements and position of the worn anode, in order to permit the correct positioning of a new anode. If so needed, also devices for the final hand adjustment may be associated to said module 1.

In part 2*b* telescopically protruding from the cleaning module 2 devices are placed for breaking the possible crust still left around the hollow space after the removal of the worn anode, which are constituted by an openable jaw pliers- or bucket-like extractor; the jaws collect the crust residuals and, once closed, are extracted from the hollow space and shifted from module 2 towards the unloading zone, which is on the opposite part of the cells relatively to that of anode replacement. To the fixed part 2*a* of said module 2 a container of alumina is associated at whose bottom a channel is connected which is arranged in such a way as to convey the alumina on the new just repositioned anode, to cover it uniformely.

To carry out automatically all the anode replacement operations, the equipment subject matter of this invention is provided with a cabin-vehicle 8, which is caused to run in both directions by an operator, parallelly to the travelling direction of bridge crane 4–4*a*; the cabin incorporates the electronic apparatuses for the correct movement of the modules, the bridge-crane, the members for the removal-positioning of the anodes and those for the removal of crust residuals.

In order to improve the automation and the positioning exactness, position transducers are associated which, connected to a computer, allow the storing and possible elaboration of the measured distances. The same movements can also be hand controlled, devices (telecameras or the like) being provided that allow a direct vision by the operator, which stays in the control vehicle. Said electronic apparatuses include at least a computer, a telecamera, monitors which "see" and check the shiftings and the work of modules 1 and 2; the approvals for the automatic execution of the process stages are sent, through suitable transmission systems, to the receiving devices associated to the modules and to the bridge crane.

Said control vehicle 8 has a loadbearing structure which can be lifted and adjusted at various heights, on which a platform 9 can be positioned, translable alternatively horizontally and replaceable, which collects the worn anodes whenever module 1 translates above the platform, and which, after the shifting of the platform for a given length on the vehicle kept standstill in the position taken at the start of the cycle, takes one or two new anodes from the same module 1, as shall be more clearly explained later on. The platform, as said, can also be provided with wheels and towed by a suitable towing-arm.

From the side of cells 6 opposite to the running side of control vehicle 8, a removable-container vehicle 10 is provided, which runs along the row of cells 6–6*a*, etc., which is stopped in correspondence of the position which cleaning module 2 assumes outside the row of cells after each removal of residuals from the anodic hollow space. The slags transported by module 2 are unloaded into said container which, after each unloading operation, is closed by a tight-cover; when container 10 is full, it is replaced by an empty one.

Always according to this invention, modules 1 and 2 are mounted suspended to the sadles so as to be free to rotate by 180° about their axis; this allows modules 1 and 2, once the anodes of a row have been replaced, to start the anode replacement of the parallel row by a simple 180° rotation of same.

That being said, a complete cycle of anode replacement, for instance of contemporaneous replacement of two adjacent anodes of a cell, is disclosed hereunder, with particular reference to FIGS. 3 to 10.

Starting from the position of the bridge crane so placed that modules 1 and 2 are in correspondence of the central line between two cells (FIG. 2) and in a position symmetrically opposite relatively to the median axis of a cell row (FIG. 1), the operator of control vehicle 8 selects, on the basis of the already programmed anode replacement card, the couple of worn anodes to be replaced, for instance the central anodes 11 and 12; the selection is made through the identification of the same anodes indicated on a line-and-column matrix. The bridge crane is then caused to move and stop automatically in the right position by a first switch which reduces the revolution speed of its motor and then by a second switch which causes it to stop, or by equivalent means; at the same time, the control vehicle 8 and the slag collection vehicle 10 are caused to move and to stop in their pre-fixed position.

Figure 3:
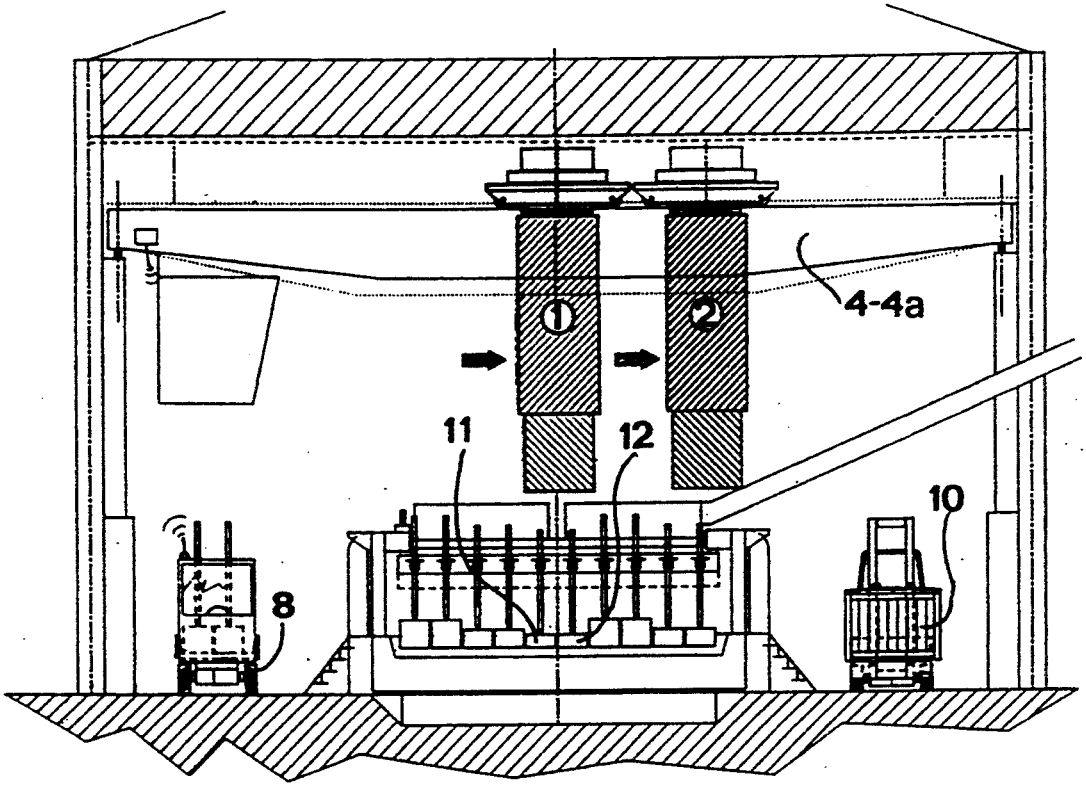
FIGS. 3 and 4 show, respectively, the positioning of the first anode replacement module on a couple of anodes to be replaced, and the positioning of the same module with the crust breaker being in working position.
Figure 4:
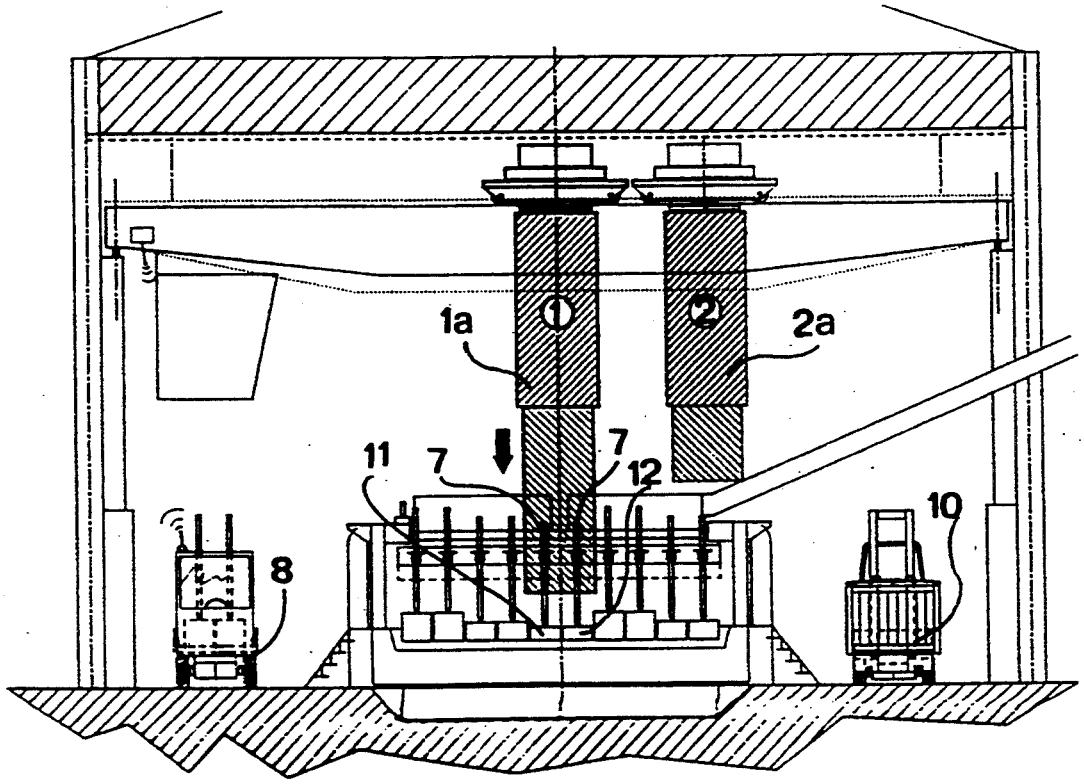

The crane bridge rests in the position reached in correspondence of the central line between two cells until the working cycle has been completed, while module 1 assumes a vertical position above shafts 7 of the two worn anodes 11–12, as shown on FIG. 3, and module 2 is shifted towards the residual unloading side. The stop of both modules in the above mentioned position is operated by contacts or position sensors placed on the cross-pieces of the bridge crane, which cause the module to shift until module 1 reaches the position above anodes 11–12 to be removed. Because of the inexactnesses or tolerances in the rails of saddles 3–3*a* and in those of the bridge crane, a limited hand adjustment may be needed to center module 1 on the anode shafts.

Figure 5:
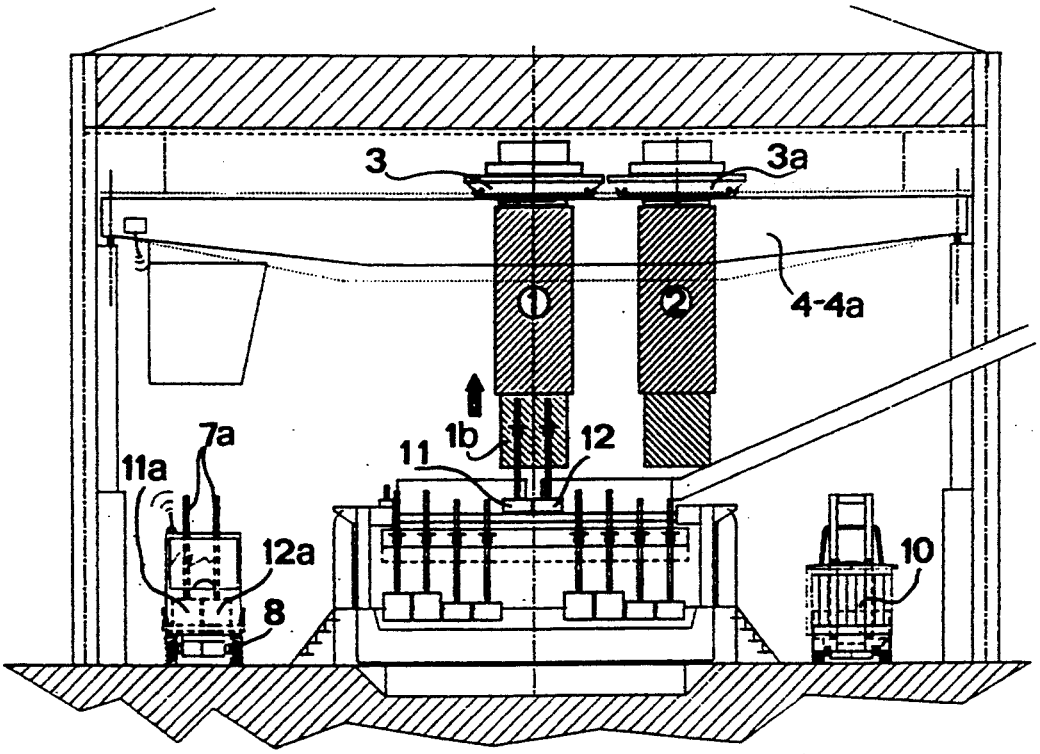
FIG. 5 shows the first anode replacement module during the lifting stage of a couple of worn anodes.
Figure 6:
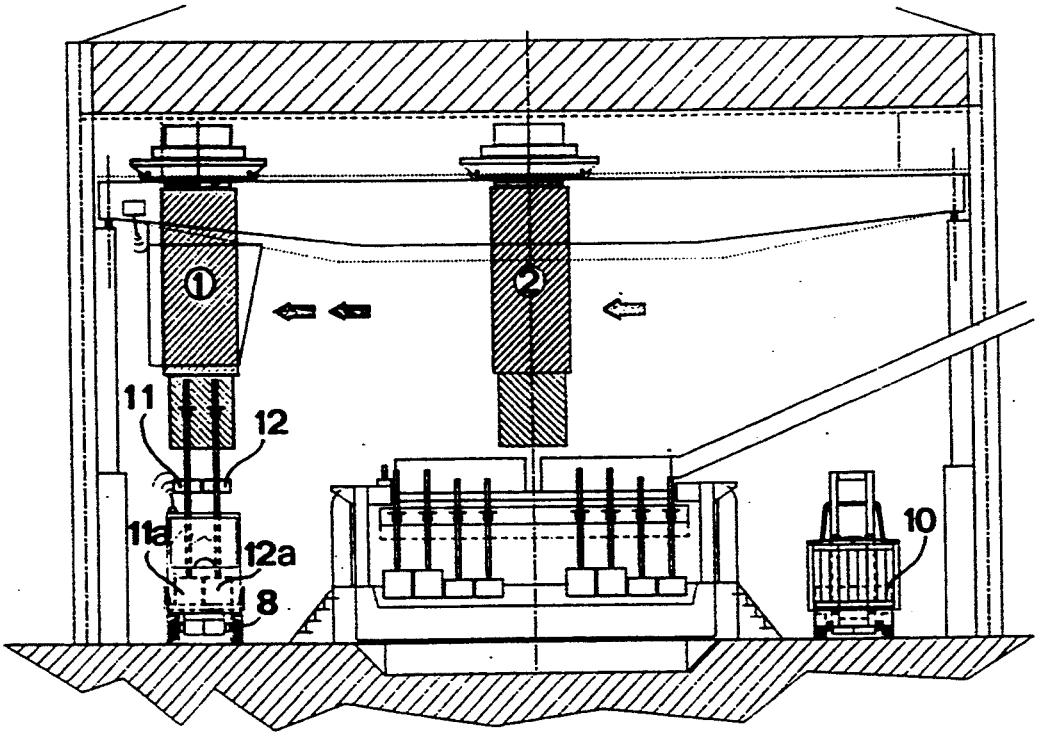
FIG. 6 shows the anode replacement module which, having moved along the aisle above the service vehicle, is in its operating position for laying the worn anodes on the platform and for the subsequent hooking of a couple of new anodes, while the second cleaning module is ready for removing the residuals of crust from the anodic hollow spaces left free by the worn anodes.
Figure 7:
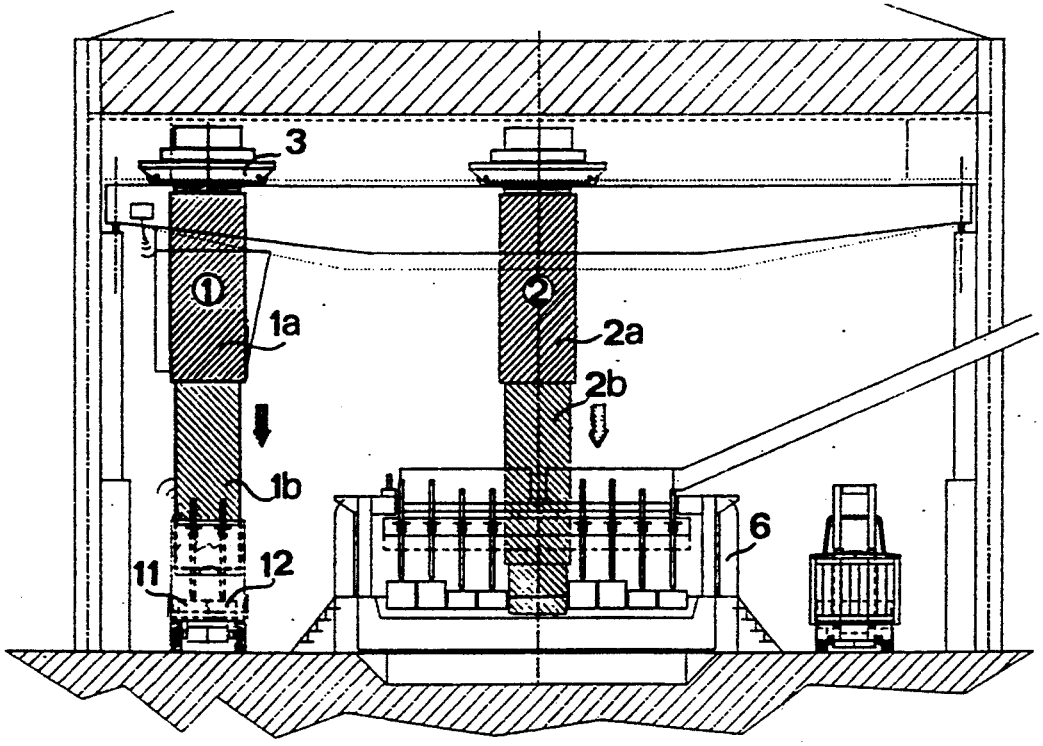
FIG. 7 shows the cleaning module in the working stage in the hollow space.

Once it has reached the position of FIG. 3, module 1 causes the lower part 1*b* (FIG. 4) to lower, the hammer and pliers for breaking first the crust around the two worn anodes to come out, and to perform then the unhooking and following hooking to shafts 7, and lastly it retracts part 1*b*, so that anodes 11–12 are removed and lifted, as shown on FIG. 5. Meanwhile the cleaning module 2 rests in the lateral position relatively to module 1.

Now, the programme set by the computer causes module 1 to shift until it is above platform 9 of the control vehicle 8 (FIG. 6), then to lay the two worn anodes in the free space 13 (FIG. 2) of platform 9, which is also a reference for the taking of new anodes.

At the same time, the cleaning module 2 shifts on the anodic hollow space and starts cleaning and scraping same, holding slags and residuals to unload them afterwards into the container of vehicle 10.

Figure 8:
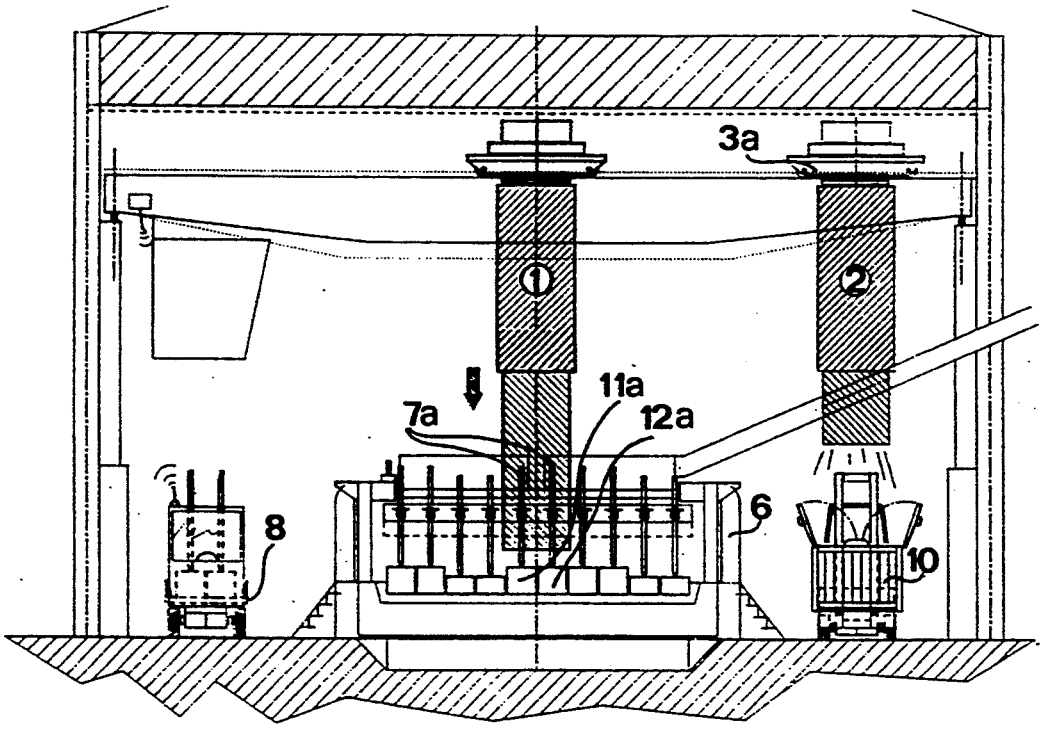
FIG. 8 shows the anode replacement module in its working position for clamping the new anodes, while the cleaning module is in the slag discharge working stage.
Figure 9:
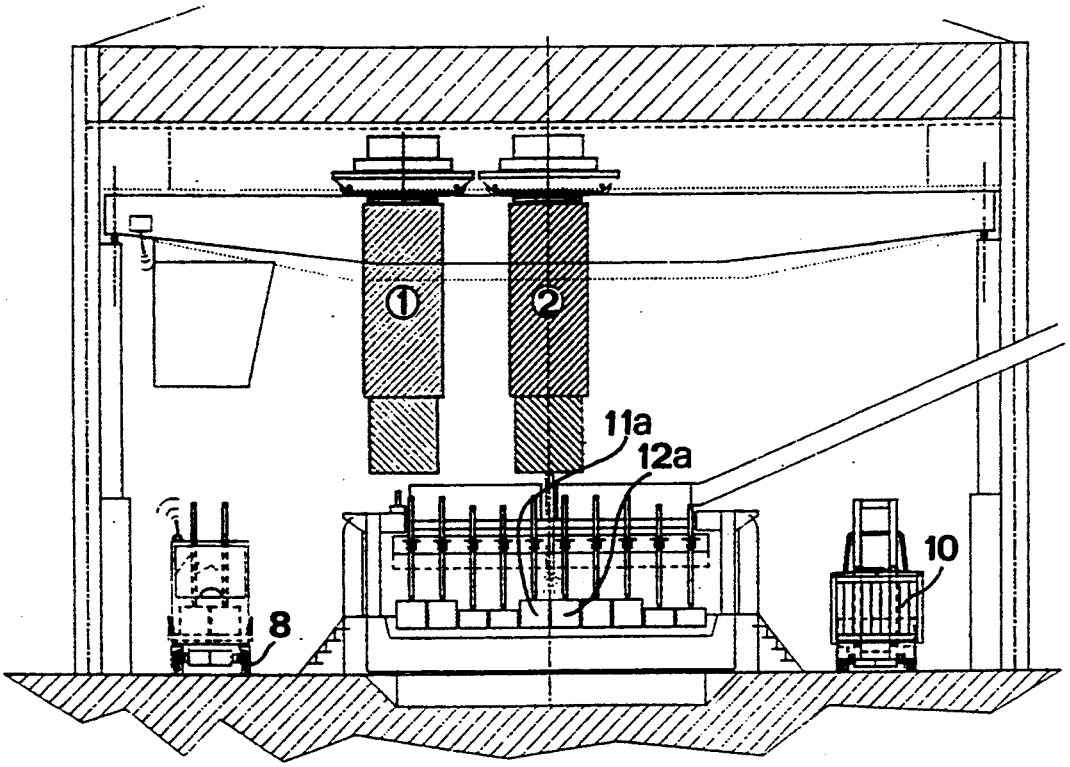
FIG. 9 shows the covering of the new anode with alumina or the like, FIG. 10 shows both modules in the starting position above the cells.
Figure 10:
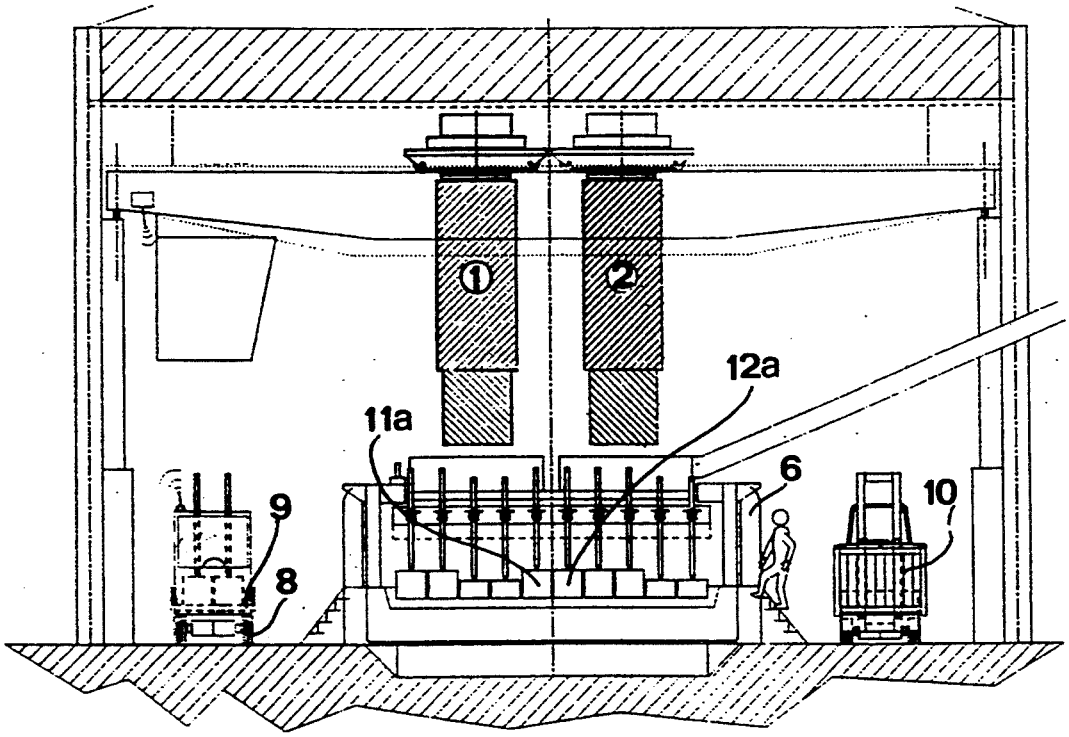
Figure 11:
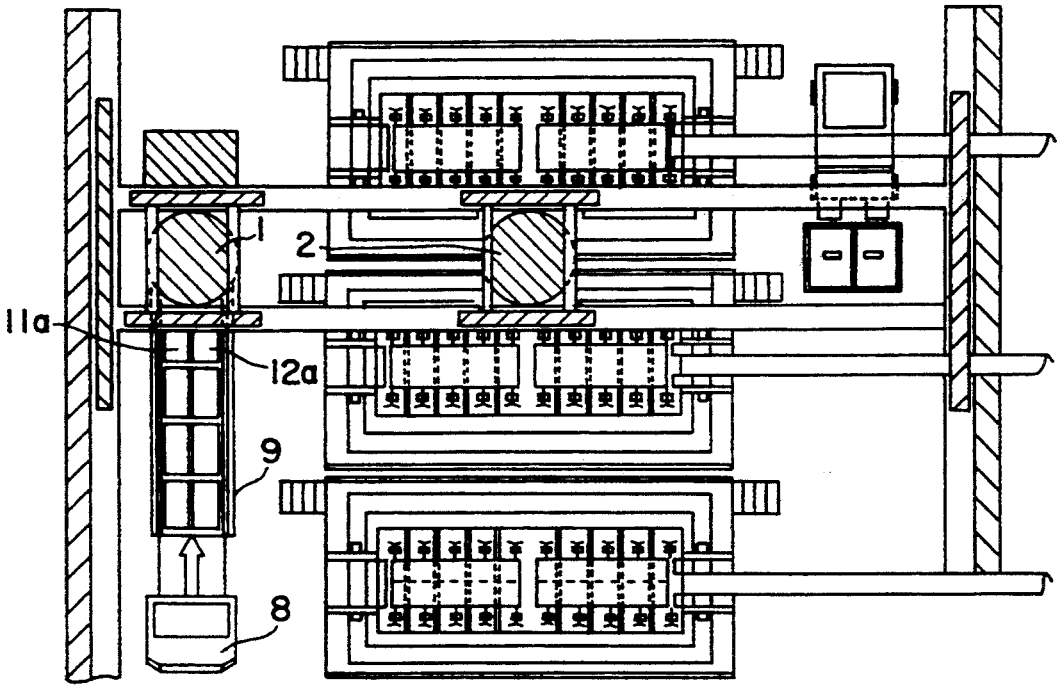
FIG. 11 is a plan view showing the movement of the platform, which allows to present to the first anode replacement module a couple of new anodes 11a and 11b instead of those worn out.

In the meanwhile, the platform of vehicle 8 translates horizontally on same, in such a way as to present two new anodes 11*a*–12*a* (FIGS. 2–7) under the pliers of module 1; the latter lowers for a length equal to the length travelled towards said platform to position the worn anodes, grips shafts 7*a* of the new anodes, and shifts then to the same heigth where it was after the removal of the worn anodes, so as to ensure the following correct positioning of the new anodes at the bottom of the cell, then is shifts above the hollow space, while module 2, which holds the crust residuals, shifts above the container of vehiche 10 which has benn previously brought by the operator to the correct position to receive the slags (FIG. 8).

Now, the two new anodes are positioned into the hollow space and connected to the bus bar, utilizing for the correct positioning the data read when the worn anodes had been removed.

Having positioned the new anodes, module 1 is shifted towards the cell side where vehicle 8 translates, while module 2 goes back above the anodes and provides to their covering wih alumina contained in he container associaed to same, as said previously.

At the end of the working cycle, both modules are brough to the starting position for a new cycle (FIG. 10), while the slag container is closed with a lid, to avoid harmful exhalations.

Once the replacement of the anodes of a row has ended, both modules can be rotated by 180° about their axis, in order to permit the anode replacement of an adjacent cell row, wherein the modules translates in opposite direction relatively to the direction of the preceding ones.

In practice, it has been ascertained that the automatized equipment for anode replacement as above disclosed brings about great advantages of a practical and economic character, besides allowing a considerable reduction in the emission of toxic gases, and requiring only one specialized operator, and in any case permitting a rapid and correct positioning of the new anodes.

I claim:

1. Modular equipment for the automatic replacement of the anodes in electrolytic cells for the production of primary aluminum, comprising:

a first operating modular unit and a second operating unit having each different tasks, and which operate contemporaneously for a great part of the whole cycle of the anode replacement operations, a bridge crane or an overhead travelling structure translable above the cell rows and provided with guides or rails placed transversally to the running direction of said bridge crane, said first modular unit or module, comprising a first saddle sliding on said guides or rails and a first structure hooked to said first saddle, a first part of the means required to perform the anode replacement operations being associated to said first structure, said second modular unit or module, comprising a second saddle sliding on said guides or rails and a second structure hooked to said second saddle, the second and remaining part of the means required to perform the anode replacement operations being associated to said second structure, a control or service vehicle provided with a supervision and control cab, translable parallelly along one of the two sides of the cell row and for the whole length of same, a container-vehicle translable parallelly along the other of the two sides of cells and for the whole length of the row, said first modular unit and said second modular unit being suitable to carry out contemporaneously working stages different from and complementary to one another, associated to the operation of anode replacement in a cell, in such a way as to substantially reduce the whole duration of the operation and to keep as low as possible or to substantially eliminate the emission of polluting and harmful smokes and gases.

2. Equipment according to claim 1, characterized in that said first part of means associated to said first module comprises hammer means for breaking the crust around a worn anode, means for unhooking the shaft of the worn anode from the anodic bus bar and for the following hooking of the shaft of a new anode to the anodic bus bar, pliers means for holding the shaft of the worn anodes when making the replacement and when taking and positioning the new anodes, said second part of means associated to said second module comprises shovel- bucket or openable vice means for the collection of slags from the anodic hollow space and their holding until they are unloaded into a closable container associated to said container-vehicle placed laterally relatively to the cells, a tank or container for containing alumina powder, and provided with means suitable to convey the powder for the covering of the upper part of the new positioned anode, said control vehicle comprises a platform for the collection of the worn anodes and the preparation of the new ones for their hooking to said first module whenever the latter translates for a prefixed length in corrispondence of said platform, in such a way as to present to said module the new anodes, keeping the height of the anode base inalterated, said vehicle being driven by an operator along a route parallel to the anode replacement cell side and for the whole length of the cell room, said platform constituting also the prior measurement means for the clamping height of the shafts of the new anodes before their transfer into the anodic hollow space, said container-vehicle, translable parallelly to the cell side opposite to that of anode replacement, is suitable to collect the slags unloaded from said second cleaning module, whenever it translates above said container vehicle, into a container provided with closable doors, so as to substantially reduce the emission of harmful smokes in the environment, said control vehicle being also equipped with a cab provided with a suitably programmed computer, remote transmission means and monitors for the realization of the sequence of the working stages and in particular for checking the position reached by said modules in the working stage and to decide on possible adjustments to be performed by hand.

3. Equipment according to claim 2, characterized in that the platform slides intermittently and with a prefixed running on the raisable structure of the control vehicle, in such a way as to allow, after the unloading of the worn anodes on the platform, the positioning of the new ones under the pliers of the anode replacement module, ensuring in this way the clamping of the shafts of the new anodes at the same height as the height where the shafts of the worn anodes have been unloaded.

4. Equipment according to claim 2, characterized in that said control vehicle is so realized as to tow a wheeled platform, carrying out in this way the translation of the platform by means of a special tow-arm.

5. Equipment according to claim 2, characterized in that said control-vehicle is so realized as to load a platform provided only with support legs, shifting under it by means of a special frame having a lifting and translation movement.

6. Equipment according to claim 1, characterized in that said first structure and said second structure are vertically hooked relatively to said first and said second saddle and are telescopically extendable.

7. Equipment according to claim 1, characterized in that said first and said second module ara rotatably anchored by at least 180° about their longitudinal axes, to allow to carry out the anode replacement operations in both the running directions of the bridge crane.

8. Equipment according to claim 1, characterized in that said modules are equipped for the contemporaneous replacement of a couple of adjacent modules, besides the replacement of one only anode at a time.

9. Equipment according to claim 1, characterized in that said control vehicle has the support of a removable platform, to allow, when it is loaded with worn anodes, to be unloaded and then re-loaded with new anodes, or replaced by an analogous platform previously loaded with new anodes.

10. Equipment according to claim 1, characterized in that the guides or rails of the bridge crane and those for the translation of the two modules are provided with sensors or run-stop switches or the like, suitable to allow to stop them in the working positions programmed by the computer.

11. Equipment according to claim 1, characterized in that it comprises:

said bridge crane or overhead travelling structure translable above the cell rows and provided with guides or rails arranged transversally to the shifting direction of said bridge crane, said first modular unit or module comprising a first saddle sliding on said guides or rails and a first structure hooked to said first saddle, said first structure being associated to hammer means for breaking the crust around the worn anode, means for unhooking the shaft of the worn anode from the anodic bus bar and for the following hooking of the shaft of a new anode to the anodic bus bar, pliers means for holding the shaft of the worn anodes when they are removed and for the following clamping and positioning of the new anodes, said first structure being also translable also transversally to the shifting direction of said first saddle and parallelly to the direction of said bridge crane, so as to translate for a given length, with the bridge crane being standstill, along the aisle laterally to the cells to unload the worn anodes on the bed of said aisle and to hook the new anodes prepared on said same bed, so as to keep the height of the anode base inalterated, said bed constituting also the preliminary measurement means for the clamping height of the shafts of the new anodes before their transfer into the anodic hollow space, said second modular unit or module comprising a second saddle sliding on said guides or rails and a second structure hooked to said second saddle, to said second saddle being associated shovel- bucket or openable vice means for the collection of slags from the anodic hollow space and their holding until they are unloaded into a closable container associated to said container-vehicle placed laterally to the cells, a tank or container for containing alumina powder, and provided with means suitable to convey the powder for the covering of the upper part of the new anode repositioned, said container-vehicle translable parallelly along the side of the cell row opposite to the anode replacement side, suitable to hold the slags unloaded by said second cleaning module whenever it translates above said container-vehicle, to said bridge crane being associated a suitably programmed computer, means for remote transmission and monitors for realizing the sequence of operating stages and in particular for checking the position reached by said modular units during the working stage, and to decide on possible adjustments to be performed by hand.

12. Modular equipment for the automatic replacement of the anodes in electrolytic cells for the production of primary aluminum, comprising:

a bridge crane or an overhead travelling structure translable above the cell rows and provided with guides or rails placed transversally to the running direction of said bridge crane, a first modular unit or module, comprising a first saddle sliding on said guides or rails and a first structure hooked to said first saddle, a first part of the means required to perform the anode replacement operations being associated to said first structure, a second modular unit or module, comprising a saddle sliding on said guides or rails and a second structure hooked to said second saddle, the second and remaining part of the means required to perform the anode replacement operations being associated to said second structure, said first modular unit and said second modular unit being suitable to carry out contemporaneously working stages different from and complementary to one another, associated to the operation of anode replacement in a cell, in such a way as to substantially reduce the whole duration of the operation and to keep as low as possible or to substantially eliminate the emission of polluting and harmful smokes and gases.

13. Modular equipment for the automatic replacement of the anodes in electrolytic cells for the production of primary aluminum, according to claim 12, comprising:

a bridge crane or an overhead travelling structure translable above the cell rows and provided with guides or rails placed transversally to the running direction of said bridge crane, a first modular unit or module, comprising a first saddle sliding on said guides or rails and a first structure hooked to said first saddle, a first part of the means required to perform the anode replacement operations being associated to said first structure, a second modular unit or module, comprising a second saddle sliding on said guides or rails and a second structure hooked to said second saddle, the second and remaining part of the means required to perform the anode replacement operations being associated to said second structure, a control or service vehicle provided with a supervision and control cab, translable parallelly along one of the two sides of the cell row and for the whole length of same, a container-vehicle translable parallelly along the other of the two sides of cells and for the whole length of the row, said first modular unit and said second modular unit being suitable to carry out contemporaneously working stages different from and complementary to one another, associated to the operation of anode replacement in a cell, in such a way as to substantially reduce the whole duration of the operation and to keep as low as possible or to substantially eliminate the emission of polluting and harmful smokes and gases.

14. Equipment according to claim 13, comprising said first part of means associated to said first module comprises hammer-like means for breaking the crust around the worn anode, means for unhooking the shaft of the worn anode from the anodic bus bar and for the following hooking of the shaft of a new anode to the anodic bus bar, pliers-like means for holding the shaft of the worn anodes when making the replacement and when taking and positioning the new anodes, said second part of means associated to said second module comprises shovel-bucket or openable vice means for the collection of slags from the anodic hollow space and their holding until they are unloaded into a closable container associated to said container-vehicle placed laterally relatively to the cells, a tank or container containing alumina powder, and provided with means suitable to convey the powder for the covering of the upper part of the new positioned anode, said control vehicle comprises a platform for the collection of the worn anodes and the preparation of the new ones for their hooking to said first module whenever the latter translates for a prefixed length in correspondence of said platform, in such a way as to present to said module the new anodes, keeping the height of the anode base inalterated, said vehicle being driven by an operator along a route parallel to the anode replacement cell side and for the whole length of the cell room, said platform constituting also the prior measurement means for the clamping height of the shafts of the new anodes before their transfer into the anodic hollow space, said container-vehicle, translable parallelly to the cell side opposite to that of anode replacement, is suitable to collect the slags unloaded from said second cleaning module, whenever it translates above said container vehicle, into a container provided with closable doors, so as to substantially reduce the emission of harmful smokes in the environment, said control vehicle being also equipped with a cap provided with a suitably programmed computer, remote transmission means and monitors for the realization of the sequence of the working stages and in particular for checking the position reached by said modules in the working stage and to decide on possible adjustments to be performed by hand.

15. Equipment according to claim 14, comprising the platform slides intermittently and with a prefixed running on the raisable structure of the control vehicle, in such a way as to allow, after the unloading of the worn anodes on the platform, the positioning of the new ones under the pliers of the anode replacement module, ensuring in this way the clamping of the shafts of the new anodes at the same height as the height where the shafts of the worn anodes have been unloaded.

16. Equipment according to claim 14, comprising said control vehicle is so realized as to tow said wheeled platform, carrying out in this way the translation of the platform by means of a special tow-arm.

17. Equipment according to claim 14, comprising said control-vehicle is so realized as to load a platform provided only with support legs, shifting under it by means of a special frame having a lifting and translation movement.

18. Equipment according to claim 13, comprising said first structure and said second structure are vertically hooked relatively to said first and said second saddle and are telescopically extendable.

19. Equipment according to claim 13, comprising said first and second module are rotatably anchored by at least 180° about their longitudinal axes, to allow to carry out the anode replacement operations in both of the running directions of the bridge crane.

20. Equipment according to claim 13, comprising said modules are equipped for the contemporaneous replacement of a couple of adjacent modules, besides the replacement of one only anode at a time.

21. Equipment according to claim 13, comprising said control vehicle has the support of a removable platform, to allow, when it is loaded with worn anodes, to be unloaded and then re-loaded with new anodes, or replaced by an analogous platform previously loaded with new anodes.

22. Equipment according to claim 13, comprising the guides or rails of the bridge crane and those for the translation of the two modules are provided with sensors or run-stop switches, suitable to allow them to stop in the working positions programmed by the computer.

23. Equipment according to claim 12, comprising a bridge crane or overhead travelling structure translable above the cell rows and provided with guides or rails arranged transversally to the shifting direction of said bridge crane, a first module unit or module comprising a first saddle sliding on said guides or rails and a first structure hooked to said first saddle, and first structure being associated to hammer-like means for breaking the crust around the worn anode, means for unhooking the shaft of the worn anode from the anodic bus bar and for the following hooking of the shaft of a new anode to the anodic bus bar, pliers-like means for holding the shaft of the worn anodes when they are removed and for the following clamping and positioning of the new anodes, said first structure being also translable also transversally to the shifting direction of said first saddle and parallelly to the direction of said bridge crane, so as to translate for a given length, with the bridge crane being standstill, along the aisle laterally to the cells to unload the worn anodes on the bed of said aisle and to hook the new anodes prepared on said same bed, so as to keep the height of the anode base unaltered, said bed constituting also the preliminary measurement means for the clamping height of the shafts of the new anodes before their transfer into the anodic hollow space, a second modular unit or module comprising a second saddle sliding on said guides or rails and a second structure hooked to said second saddle, to said second saddle being associated shovel-bucket or openable vice means for the collection of slags from the anodic hollow space and their holding until they are unloaded into a closable container associated to said container-vehicle placed laterally to the cells, a tank or container containing alumina powder, and provided with means suitable to convey the powder for the covering of the upper part of the new anode repositioned, a container-vehicle translable parallelly along the side of the cell row opposite to the anode replacement side, suitable to hold the slags unloaded by said second cleaning module whenever it translates above said container-vehicle, to said bridge crane being associated a suitably programmed computer, means for remote transmission and monitors for realizing the sequence of operating stages and in particular for checking the position reached by said modular units during the working stage, and to decide on possible adjustments to be performed by hand.

* * * * *